United States Patent [19]

Richardelli

[11] Patent Number: 4,900,329

[45] Date of Patent: Feb. 13, 1990

[54] METHOD FOR MAKING PALLETS

[75] Inventor: Joseph Richardelli, Fredericksburg, Va.

[73] Assignee: The Salk Institute for Biological Studies, San Diego, Calif.

[21] Appl. No.: 219,739

[22] Filed: Jul. 15, 1988

Related U.S. Application Data

[62] Division of Ser. No. 863,926, May 15, 1986, Pat. No. 4,757,605.

[51] Int. Cl.[4] ..... B21J 5/00

[52] U.S. Cl. ..... 29/430; 29/432

[58] Field of Search ..... 227/6, 142, 152, 109; 29/432, 798, 430

[56] References Cited

U.S. PATENT DOCUMENTS

| | | | |
|---|---|---|---|
| 2,856,606 | 10/1958 | Richards | 227/117 |
| 3,557,439 | 1/1971 | Dykeman | 29/772 |
| 3,968,560 | 7/1976 | Vial | 29/430 |
| 4,039,111 | 8/1977 | Rogers | 227/152 |
| 4,168,566 | 9/1979 | Streckert | 29/432 |
| 4,235,005 | 11/1980 | James | 29/798 |
| 4,392,600 | 7/1983 | Billett et al. | 29/432 |
| 4,403,388 | 9/1983 | Belcher | 29/798 |
| 4,441,643 | 4/1984 | McCutchen | 227/152 |
| 4,492,016 | 1/1985 | Smets et al. | 27/784 |

*Primary Examiner*—Joseph M. Gorski

*Attorney, Agent, or Firm*—Fitch, Even, Tabin & Flannery

[57] ABSTRACT

A method and apparatus for manufacturing wooden pallets including a vertically-reciprocating nailing head for nailing deckboards to stringers and a limit switch arrangement for adjusting the stroke length of the nailing head individually for each deckboard, so that in each deckboard, all of the nails will be driven to a uniform vertical position. A gripper carriage effects horizontal movement of pallets at various stages of completion. Hydraulic drive means are provided for both the nailing head and the gripper carriage.

3 Claims, 8 Drawing Sheets

FIG_7
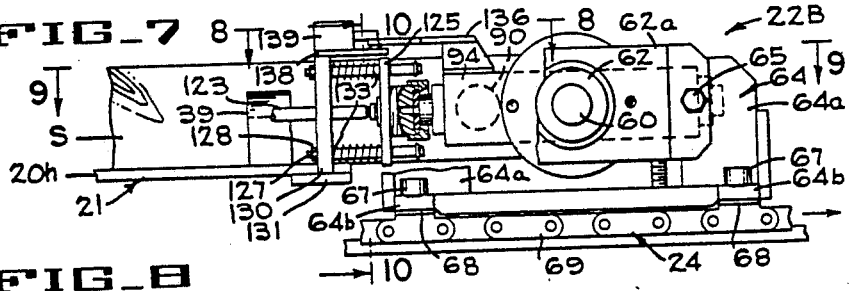
FIG_8
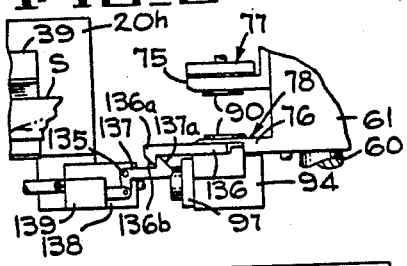
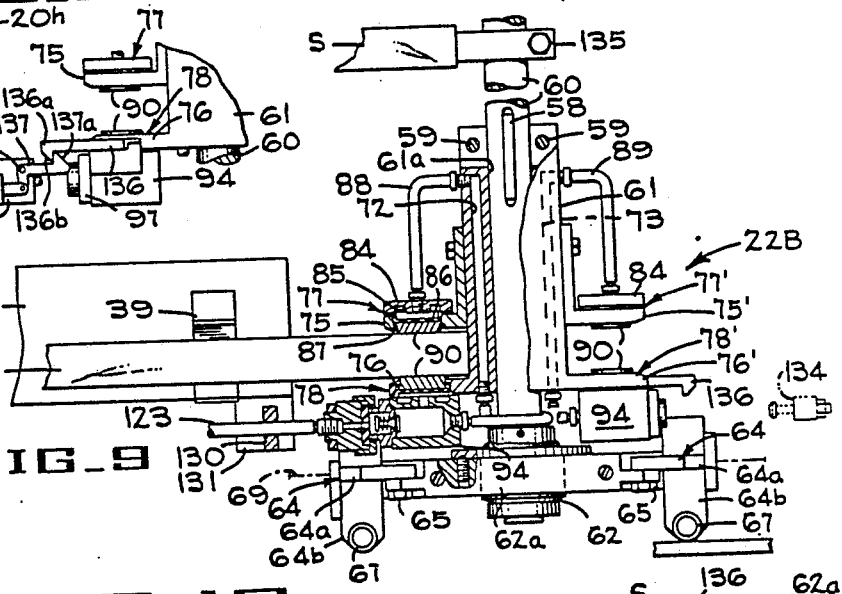
FIG_9
FIG_10
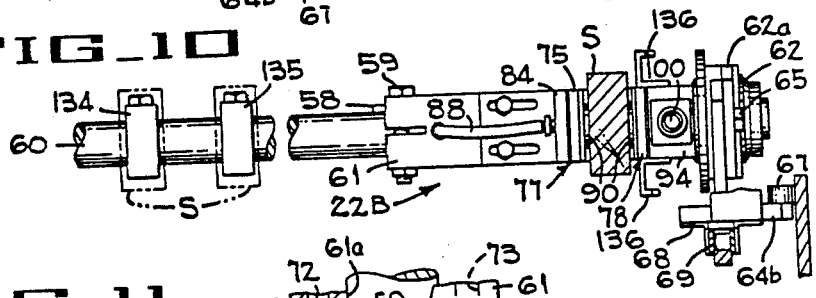
FIG_11
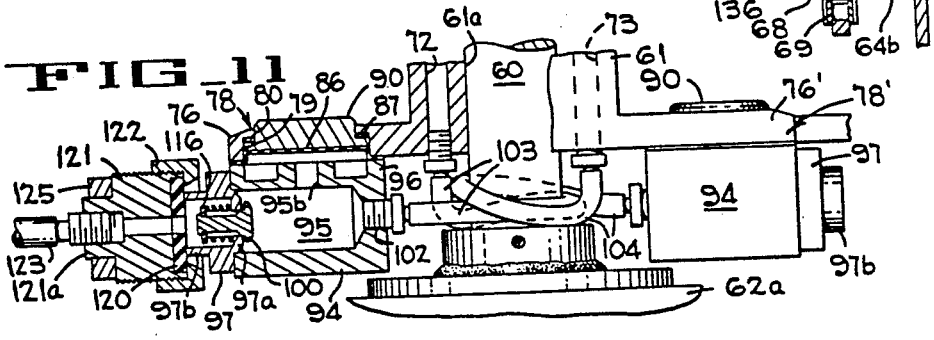

FIG_12
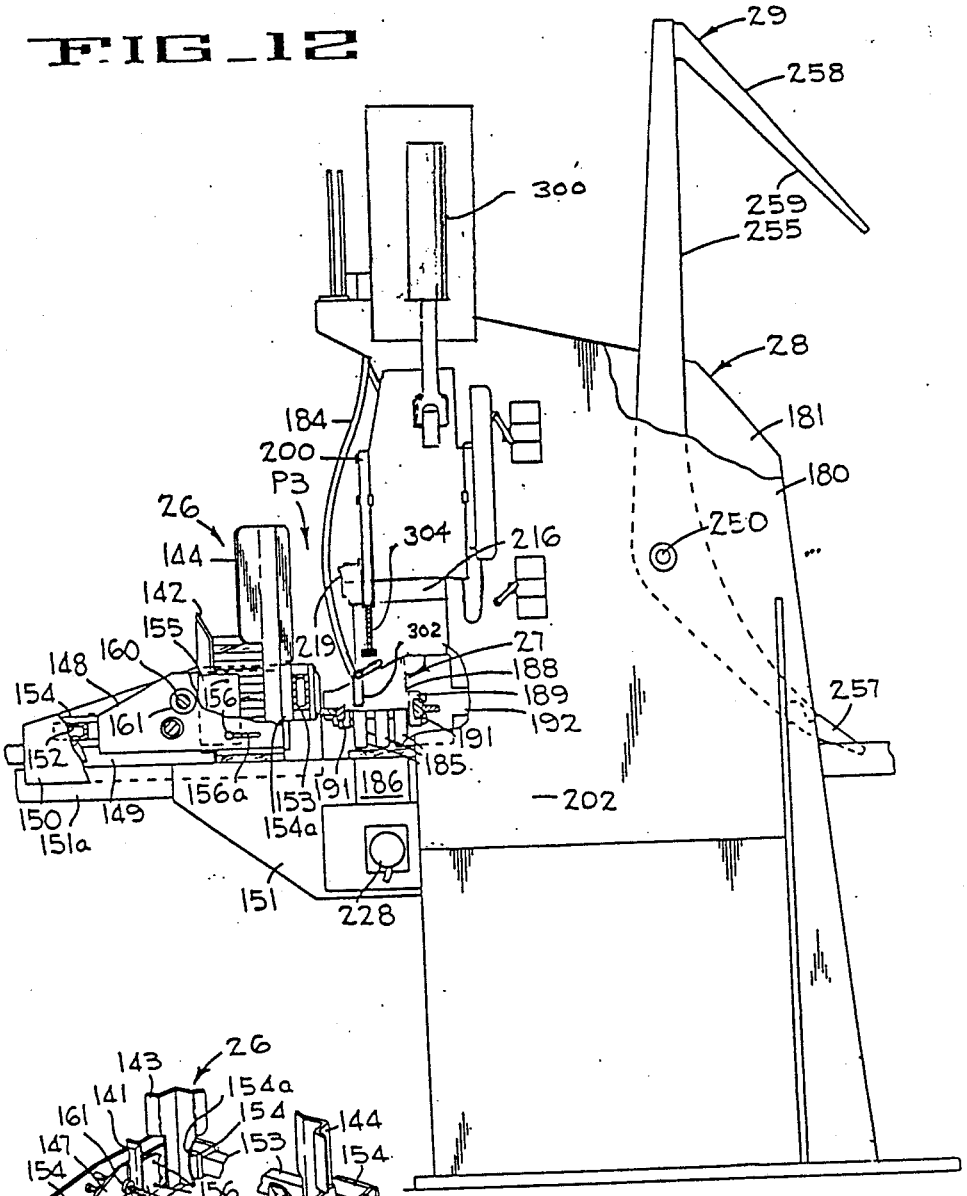
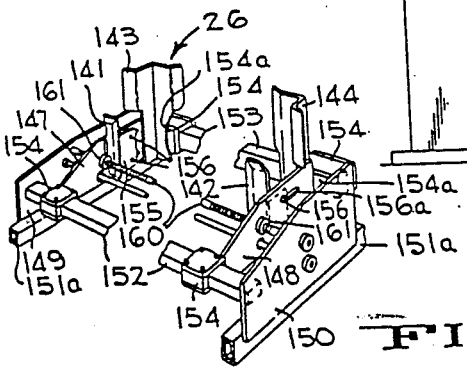
FIG_13

FIG_15
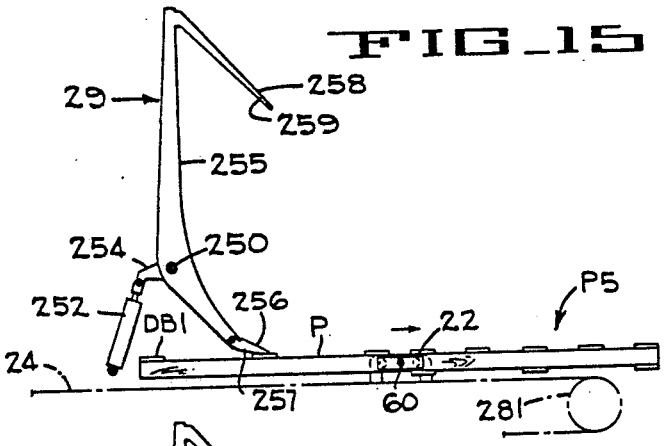
FIG_16
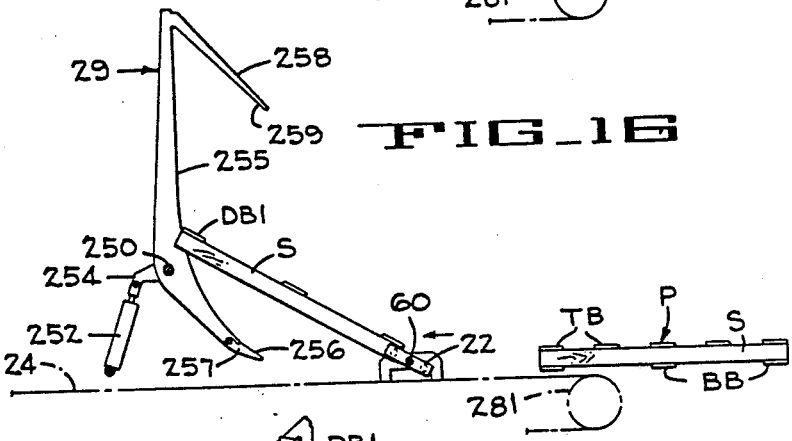
FIG_17
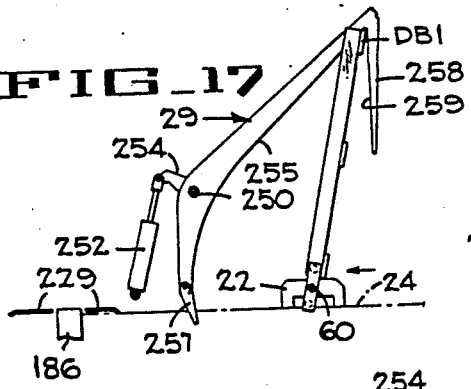
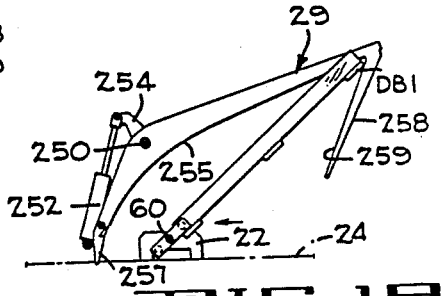
FIG_18
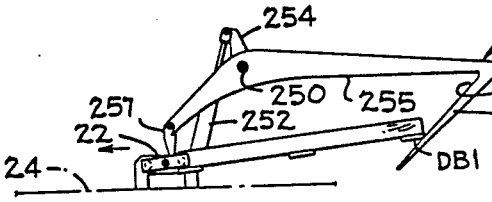
FIG_19

V13
281
282
308
299
281
V12
258
259
29
255
306
300
69
V10
V8
V7
V5
V3
V1
V11
V9
V6
V4
V2
254
250
252
257
200
193
192
230
231
228
226a
168
169
170
165a
165
227
166
167
22B
62a
64
280
61
60
22A
22
121
137
139
51
25
40
20h
20g
20f
20e
20
21
50
53
24
275

METHOD FOR MAKING PALLETS

This is a division of Ser. No. 865,926, filed 5/15/86, now U.S. Pat. No. 4,757,605.

BACKGROUND OF THE INVENTION

The invention relates to a method and apparatus for manufacturing wooden pallets, and more particularly to a method and apparatus wherein a single nailing machine is used for nailing both the top deckboards and the bottom deckboards to the stringers.

A method and apparatus of the type generally described above are disclosed in U.S. Pat. No. 4,392,600, which is incorporated herein by reference. According to the method and apparatus disclosed therein, each pallet is manufactured by first nailing the deckboards to one side of the pallet, preferably the bottom, then inverting the partially-completed pallet and nailing the deckboards to the opposite side. Horizontal transportation of the pallet during manufacture is provided by a horizontally-driven gripper carriage which engages the stringers. The gripper carriage pulls the stringers to the nailing station and stops at a predetermined point for the first deckboard to be nailed thereon, then advances a predetermined distance and again stops for the second deckboard to be nailed thereon, and proceeds in this manner until the first set of deckboards have been nailed to the stringers.

The gripper carriage includes a gripper assembly which has a forward set of grippers and a rearward set of grippers so that the gripper assembly can simultaneously grip two separate sets of stringers, one forwardly of the gripper assembly and one rearwardly thereof. The gripper assembly is rotatable about a transverse horizontal axis so that the pallet may be inverted while held by the gripper assembly by a turnover mechanism. After nailing of the first set of deckboards to the stringers, the nailing head pulls the partially completed pallet beyond the nailing head, then reverses direction to push the pallet into engagement with the turnover mechanism to invert it. After inversion, an empty set of grippers faces rearwardly. The gripper carriage then pulls the inverted, partially-completed pallet back through the nailing station, engages the forward ends of a second set of stringers, and then proceeds forward to push the partially completed pallet through the nailing station for attachment of the top deckboards thereto, pulling the second set of stringers along behind. After nailing of the top deckboards to the first set of stringers, the second set of stringers is pulled through the nailing station for the bottom set of deckboards to be nailed thereon. Once this has been completed, the gripper carriage advances forwardly to a predetermined point at which the first pallet, having been completed, is released. The gripper carriage then reverses direction to invert the second pallet and pick up a third set of stringers, repeating the steps described above.

The nailing operation in U.S. Pat. No. 4,392,600 involves vertical movement of a large, heavy nailing head which includes a plurality of punches for driving nails downwardly through the deckboard stringers. The nailing head is driven through a fixed stroke by a continuously rotating electric motor that is connected to the head by a crank arrangement, with a brake-clutch assembly interposed between the motor and the head so that the reciprocating movement of the head need not be continuous.

The present invention relates to a method and apparatus which provide many of the advantages of the method and apparatus set forth in U.S. Pat. No. 4,392,600, and additionally provide improved performance and durability for the apparatus.

SUMMARY OF THE INVENTION

In accordance with the invention, a method and apparatus for manufacturing wooden pallets are provided wherein the vertical stroke of the nailing head is individually adjusted for each individual deckboard so that for each deckboard, the nails will be driven to a uniform predetermined height relative to the upper surface of the deckboard. This enables the nailing head to compensate for minor variations in thickness between different deckboards in a particular pallet. The preferred apparatus includes hydraulic drive means for both the nailing head and the gripper carriage.

BRIEF DESCRIPTION OF THE DRAWINGS

FIG. 7 is a fragmentary side elevation taken along line 7—7 of FIG. 4, particularly showing the gripper carriage.

FIG. 8 is a fragmentary plan view taken looking in the direction indicated by arrows 8—8 of FIG. 7.

FIG. 9 is a fragmentary plan view taken as indicated by line 9—9 of FIG. 7.

FIG. 10 is a fragmentary section taken on line 10—10 of FIG. 7.

FIG. 11 is an enlarged view of a portion of FIG. 9.

FIG. 12 is a side elevation, with parts broken away, of the nailing machine used in the present pallet-assembly machine.

FIG. 13 is a fragmentary schematic isometric view of the deckboard hopper mounted on the nailing machine of FIG. 12.

FIGS. 15–19 are diagrammatic views showing consequence positions of the half-pallet turn-over bar of the pallet-assembly machine.

DESCRIPTION OF A PREFERRED EMBODIMENT

Figures 1, 2:
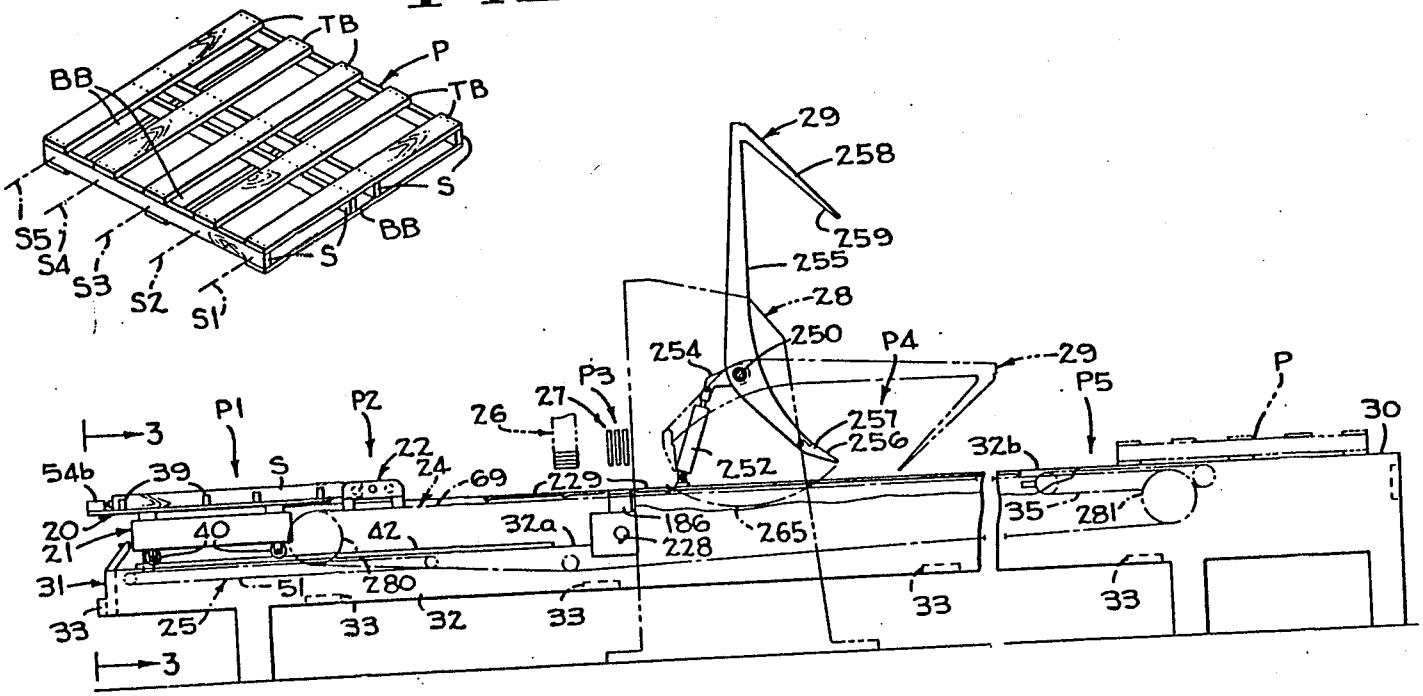
FIG. 1 is an isometric view of a pallet of the type that is fabricated by the machine of the present invention.
FIG. 2 is a schematic side elevation of the pallet-assembly.
Figure 2A:
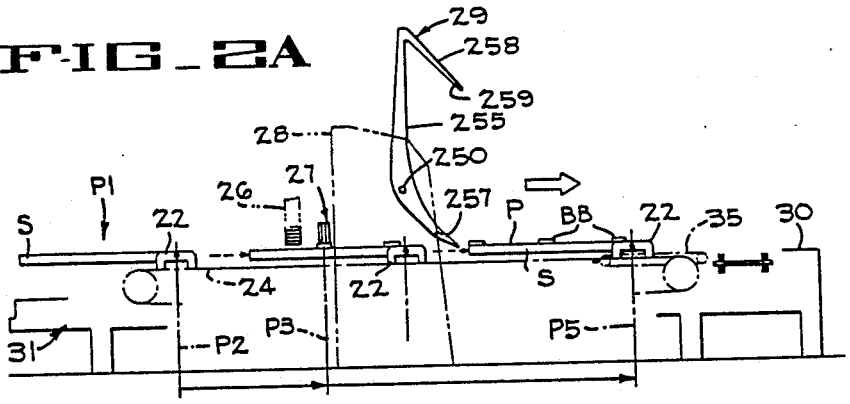
FIGS. 2A–2D are a set of diagrammatic partial side elevations of the machine, showing the sequence of operations that machine performs in making pallets.
Figure 2B:
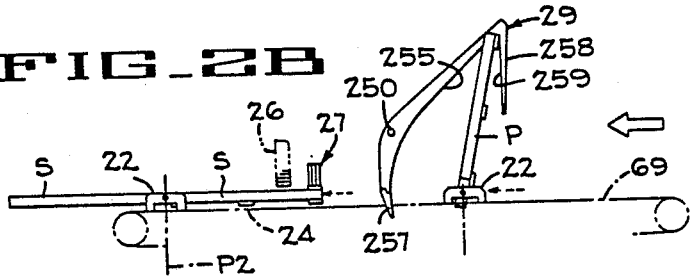
Figure 2C:
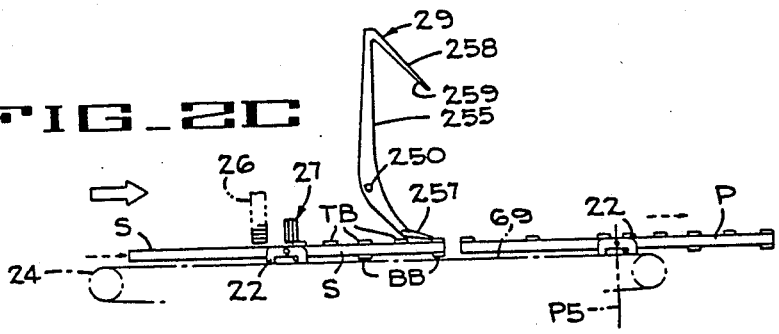
Figure 2D:
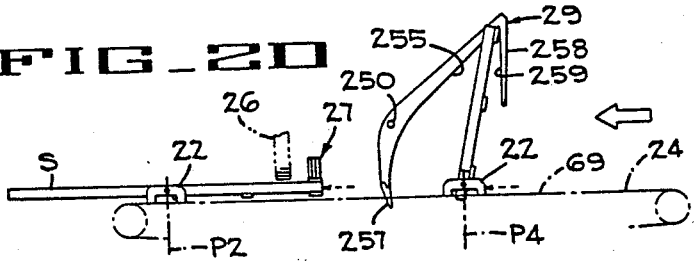

In FIG. 1 is illustrated a pallet P of a type that is fabricated by the machine of the present invention. The pallet comprises a series of spaced, parallel, longitudinally-extending stringers S to which a plurality of top boards TB and a plurality of bottom boards BB are nailed. The sequence followed by the machine in first nailing bottom boards to the stringers and then the top boards is schematically indicated in FIGS. 2A–2D. In general, at Station P1 the operator places the four stringers S in parallel position on a fixture 20 mounted on a roller carriage 21. A gripper head 22, which is carried back and forth in a horizontal path by a chain drive mechanism 24, is then moved to the left to Station P2 into gripping engagement with the leading edges of the two outermost stringers. The gripper head 22 is next moved to the right, pulling the carriage with it toward a nailing Station P3. An air motor drive mechanism 25 also urges the stringer carriage toward nailing Station P3 and, when the leading ends of the stringers reach that station, the gripper heads release the carriage and the drive mechanism 25 holds the carriage in a stationary position. A deckboard is moved forwardly from a hopper 26 and positioned on the leading ends of the stringers under a series of nailing chucks 27 of a nailing machine 28 which drive nails down through the deckboards and into the stringers. When the first deckboard has been nailed in place, the gripper head is again indexed to bring the middle sections of the stringers under the nailing chucks at Station P3 and a second deckboard is positioned on the stringers under the nailing heads and nailed to the stringers. This indexing movement of the gripper head and the positioning and nailing of deckboards is continued until the predetermined desired number of bottom deckboards has been nailed to the stringers.. It will be noted that, during the indexing movement of the gripper head, the stringers are progressively pulled out of the stationary fixture 20 and the half-pallet is partially completed, the air motor drive mechanism 25 returns the stringer carriage and its fixture to Station P1 to receive another set of stringers.

When the last bottom deckboard has been nailed on the stringers, and the formation of a half-pallet has been completed, the gripper is moved to Station P5 at the end of its travel to the right. At this point the anvil is lowered by one deckboard thickness. The movement of the gripper head is then reversed and it pushes the half-pallet toward the left and through an inverting mechanism 29 at Station P4 at which the half-pallet is inverted and continues its movement toward the left. When it reaches Station P2 it engages with the new stringers that have been positioned there by the operator. When the stringers have been engaged, the gripper head moves toward the right to progressively move the stringers through Station P3 where the five top deckboards are nailed thereon. The nailing anvil is raised by one deckboard thickness and the gripper head then moves the new stringers through Station P3 to have three bottom deckboards nailed thereon. When the gripper head reaches reversing Station P5, the completed pallet, which is moving along ahead of the gripper, is released by the gripper and moved onto a flat support surface 30 at the end of the frame of the machine by a conveyor 35. During its subsequent movement to the left, the gripper moves the half-pallet through the inverter at Station P4 and continues back to Station P2 to grip a new set of stringers put in place by the operator.

The pallet assembly machine comprises an elongated frame support structure 31 having spaced side walls 32 and transverse beams 33 extending between the side walls to form a rigid unitary structure. It will be noted that the upper surface **32*a* of the side walls are at one elevation from the infeed end of the machine to a point just past the nailing chucks 27 and that thereafter the surface 32*b*** of the side members is at a higher elevation.

The stringer carriage 21 includes four rigid plates **20*a*–20*d* (FIGS. 3 and 4) secured together to form a rectangular frame, and four longitudinally-extending plates 20*c*–20*h* secured on the upper ends of angle brackets 20*i* and upwardly opening channel brackets 20*j*. A plurality of upwardly-opening U-shaped spring clips 39 (FIG. 3) are secured to the plates 20*e*–20*h* to form four lines of clips, the clips of each line being in alignment longitudinally of the machine. Four wheels 40 are mounted on the underside of the carriage, two on each side under the side plates 20*a* and 20*c*, and these wheels are arranged to roll along the upper surface of two spaced tracks 41 and 42. The tracks are mounted on the machine frame 31 and extend from the left end (FIG. 1) of the machine to a point just upstream from the deckboard hopper 26. The drive mechanism 25 which moves the carriage along the tracks 41 and 42 includes a pusher arm 50 (FIG. 5) carried on and projecting upwardly from the upper run of an endless chain 51. The arm 50 is secured at its upper end to an L-shaped angle 52 carried by the transverse member 20*b* of the carriage so that, when the upper run of the chain is driven to the right (FIG. 1), the lug will move the carriage to the right whereas, if the chain is driven to the left, the lug will push the carriage toward the left. The endless chain 51 (FIG. 3) is driven by an air motor 53 controlled through a solenoid-operated valve V1. A stop 54*a* carried by a transverse member of the frame of the machine limits the movement of the stringer carriage toward the left while a stop 54*b*, carried on each of the four longitudinal members 20*e*–20*h*** of the carriage, act as positioning members for one end of each stringer.

The gripper carriage 22 is made up of two gripping heads 22A and 22B (FIG. 4) which are identical but oppositely disposed near opposite ends of a cross-shaft 60. Each of the units includes a cylindrical housing 61 connected by a key 58 (FIG. 9) and by clamping bolts 59 to the cross-shaft 60 that is rotatably journaled at each end in a bearing 62. Each bearing 62 is locked to a carrier bracket 64 by bolts 65 which secure each end of a plate **62*a* of the bearing assembly 62 to the carrier bracket. Each bracket 64 has an upstanding arm 64*a* and a laterally-extending arm 64*b* at right angles to arm 64*a* and carrying a roller 67 near its end. The arm 64*b* of each bracket 64 is mounted on a pair of angle links 68 (FIG. 10) of a drive chain 69 which, as seen in FIG. 2**, extends from a point upstream of Station P2 to a point past Station P5.

The cylindrical housing 61 of each gripper unit has a central cylindrical opening **61*a* receiving the shaft 60 and a pair of passages 72 and 73. On one side, the housing 61 has two spaced flanges 75 and 76 projecting outwardly, the flange 76 being formed integrally with the housing 61 and the flange 75 being one arm of an angle secured to the housing. The flange 75 carries a gripper unit 77, and the flange 76 carries a gripper it 78. Diametrically opposite the flanges 75 and 76 on the cylindrical housing 61 are identical flanges 75' and 76', respectively, the flange 75' carrying a gripper unit 77' and the flange 76' carrying a gripper unit 78'. Each of the four flanges has a cylindrical opening 79 (FIG. 11) concentric with a reduced diameter opening 80 adjacent one face of the flange. A plate 84 (FIG. 9) having an annular groove 85 formed therein is secured, by capscrews or the like, to each of the flanges 75 and 75' with the annular groove in confronting relation with the cylindrical opening 79 in the flange and providing a pressure chamber that is closed on one side by a rubber diaphragm 86 which is locked between the plate 84 and the flange. The passages 72 and 73 in the housing 61 communicate with the pressure chambers by conduits 88 and 89 respectively which are connected to fittings that are in flow communication with the passages and the chambers. A pressure pad 90 is positioned adjacent one face of each of the diaphragms 86 and is disposed for reciprocating movement in the cylindrical opening 79 provided by the associated flange. A wave washer spring 87 (FIG. 11) is positioned between the pressure pads 90 and the housings 75 and 76**.

Similarly, a housing 94 is secured to each of the flanges 76 and 76'and each housing has one wall 96 provided with an annular groove which confronts the opening 79 in the adjacent flange and provides a pressure chamber which is bounded on one side by the diaphragm 86 that is carried by the flange. Each of the housings 94 is hollow and provides a central chamber 95 communicating respectively with the pressure chambers in the flanges 76 and 76' by a short passage **95*b***.

Each housing is closed at one end by a cylindrical member 97 that is secured to the housing 94 and has an inwardly projecting flange **97*a* which provides a seat for a check valve 100. At one end the member 97 has a reduced diameter end 97*b*. A fitting 102 is connected in an end wall of each housing 94, one fitting communicating through a flexible conduit 103 with the passage 72 in the housing 61 and the other fitting communicating with passage 73 through flexible conduit 104. Each of the check valves 100 is urged to a closed position by a coil spring disposed around the stem of the valve between a snap ring 116 on the valve stem and the inwardly projecting flange 97*a***.

When a pair of gripper units, either 77, 78 or 77', 78' approach Station P2, the reduced diameter end of the leading housing 94 engages a rubber pad 120 that is held in a cylindrical recess in a cylindrical chuck 121 by a retainer ring 122. The rubber pad and the chuck 121 have aligned central passages that communicate with a flexible conduit 123 leading to a supply of pressurized air. The chuck 121 has a cylindrical end **121*a* that is pressed in a plate 125 (FIG. 7) which has a hole at each end that slidably receives a rod 127. Each rod 127 is locked by a nut 128 on a plate 130 which is secured to and projects upwardly from a lateral extension 131 of the stringer carriage 21. The plate 130 also slidably supports conduit 123. A coil spring 133 is disposed around each rod 127 between the plates 125 and 130. Just before the gripper units reach Station P2, the contact of the end of the housing 94 with the rubber pad 120 causes the chuck, the conduit 123, and the plate 125 on which the chuck is mounted to move slightly toward the left (FIG. 7) against the resistance of the springs 133. When the gripper units arrive at Station P2, a valve (to be described presently) in the control system establishes communication between conduit 123 and the source of pressurized air, causing the air to pass through the chuck and move the head of the check valve 100 off its seat. The pressure chambers adjacent the diaphragms 86 of whichever pair of opposed housings 84, 94 or 84', 94' is at Station P2 receive air and the chambers are expanded to urge the gripping pads 90 into gripping engagement with the two outermost stringers. One of the pads in each pair is slightly larger in diameter than its cooperating pad. Accordingly, when the gripper heads are subsequently moved toward the right (FIG. 1) and the stringer carriage is moved along with the heads, the leading ends of the four stringers are brought to a position at the nailing station P3. Also, when the gripper heads arrive at Station P2 the sides of the two housings 61 and two stops 132 and 132*a*, that are adjustably mounted on the cross bar 60** between the gripper heads, engage the ends of the four-stringers and flush them into a common plane extending transversely of the machine.

Referring to FIG. 8, a rigid latch bar 136 is mounted on each flange 76 and 76' of the housing 61 on the side of the flange that faces upwardly when that flange is at the stringer pick-up end of the machine. The latch bar has a laterally-projecting end **136*a* with a slanted leading edge 136*b* adapted to engage the slanted leading edge 137*a* of a latch lever 137 and pivot the latch lever 137 clockwise about a pin 135 that mounts the lever on an upper flat horizontal plate 138 which is secured to the upper end of the chuck-support plate 130. It will be evident that, as the gripper head moves toward the left (FIG. 8), the latch bar 136 will pivot the lever 137, and move past it as the head moves into engagement with the air chucks 121. Then, when the gripper heads again move toward the right, the latch bar will engage the latch lever and pull the stringer carriage with the gripper heads. When it is desired to release the gripper carriage from the gripper heads to permit it to return to the loading station, the lever 137 is pivoted clockwise by a solenoid 139 mounted on the plate 138**.

During an initial part of the operation when deckboards are being nailed on the stringers that trail the gripper carriage, the stringer carriage moves along with the gripper carriage and the gripper heads remain in engagement with the air chucks 121. During the deckboard-adding operation, the stringer table is moved rearwardly away from the gripper carriage to return to its initial position to receive another set of stringers. The check valve 100 of each gripper head is effective to lock a charge of air in the gripper head that holds the pads 90 in gripping engagement with a stringer all during the time that bottom boards are nailed to one side of the stringers to form a half-pallet, the half-pallet is moved rearwardly and inverted, and then moved forwardly again to have deckboards nailed to its other side. When the completed pallet reaches station P5, each of the two gripper heads that are advancing the pallet move into engagement with an abutment 134 that is shown in phantom lines at the right side of FIG. 9. The end **97*b* of the gripper head housing 94 telescopes over the abutment which engages and unseats the valve 100 to vent the gripper head and release the pallet so that the diverter conveyor 35 can discharge the pallet. The abutment 134 is shown in phantom lines in FIG. 9 since it is out of its actual location near the conveyor 35**.

The deckboard feeder comprises the deckboard hopper 26 made up of four upright angle members 141–144 (FIG. 13) which define the corners of the hopper. The angle members 141 and 142 are identical, only facing in opposite directions to define the forward inside corners of the hopper. Similarly, the members 143 and 144 are identical but oppositely disposed and define the rear corners. The corner members are positioned between two mounting plates 147 and 148 which, in turn, are positioned between two plates 149 and 150, each of which is secured to and projects upwardly from a member **151*a* of a side bracket 151 (FIG. 12) projecting from each side of the support structure of the nailing machine 28. Two box beams 152 and 153 are secured to and extend between the outer plates 149 and 150, and the inner plates 147 and 148 are adjustably slidable on these box beams by means of box-like collars 154, one of which is secured to both the forward and the rear ends of each of the inner plates. Each of the rear corner members 143 and 144 of the hopper is mounted on one of the members 154***a* of an adjacent collar 154 and, accordingly, the rear corner members 143 and 144 of the hopper are mounted for movement laterally of the machine with the inner side plates 147 and 148. On its outer face, each of the front corner members 141 and 142 carries a forwardly-extending plate 155 having holes arranged to receive bolts 156 therein, and each bolt extends through one of two slots 156*a* in the plate 147 or plate 148. Thus the front corner members are mounted directly on the plates 147 and 148 for adjusting movement toward and away from the rear corner members to vary the width of the deckboard hopper and for lateral adjustment with the rear corners to vary the length of the hopper. The inner plates 147 and 148 on which the corner members are supported are moved laterally of the machine on the box beams 152 and 153 by a feed screw 160 which is rotatably journaled in the outer side plates 149 and 150 and has oppositely cut threads at either end to engage nuts 161 mounted in each inner plate 147 and 148. When the feed screw is rotated, the plates 149 and 150 move toward or away from each other.

Figures 3, 4, 5, 6:
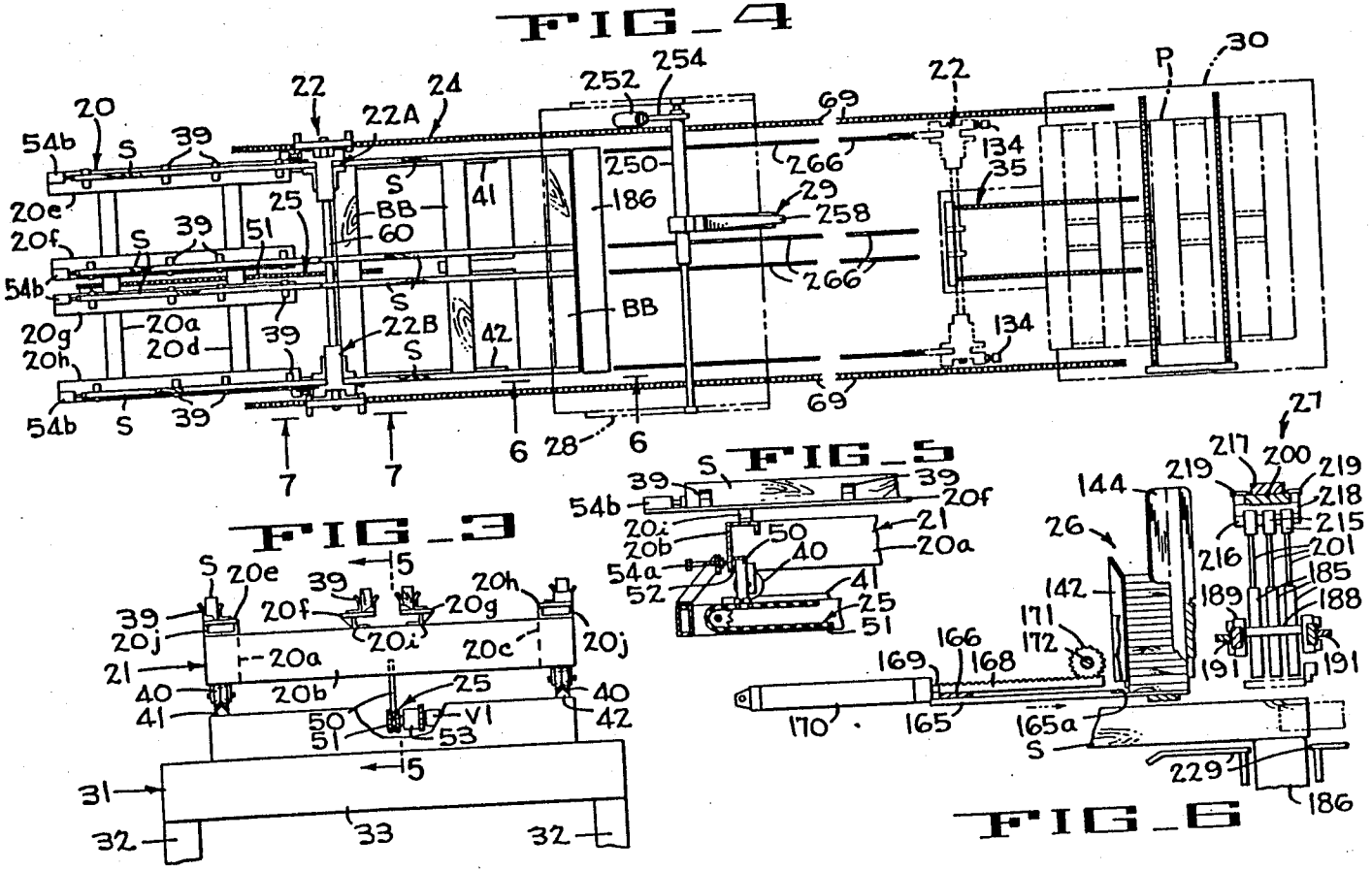
FIG. 3 is a schematic end elevation of the machine taken looking in the direction of arrows 3—3 of FIG. 2.
FIG. 4 is a schematic plan view of the machine.
FIG. 5 is a schematic section taken on line 5—5 of FIG. 3.
FIG. 6 is a fragmentary side elevation taken in the general area indicated by line 6—6 of FIG. 4.

The bottom deckboard is removed from the hopper and fed forwardly to the nailing position by means of two stripper bars 165 (FIG. 14) which are carried on a connecting plate 166 that extends transversely of the machine and is connected at its ends to the underside of two racks 167 and 168. Each rack is carried on the outer end of the piston rod 169 of a double-acting pneumatic power cylinder 170 (one only being shown in FIG. 14). The movements of the two racks are coordinated by two pinions 171 that are keyed to a transverse shaft 172. As seen in FIG. 6, each stripper bar 165 has a forward surface and a rearward surface separated by a pusher shoulder 165*a*. When one end of each of the power cylinders is energized, each piston rod is projected out of the cylinder and the pusher shoulder 165*a* of the stripper bar engages the lowermost deckboard and pushes it out from under the stack and into a position under the chucks 27 of the nailing machine. As the stripper bars are moving forwardly to position a deckboard, the stack of deckboards moves downwardly bringing the lowermost deckboard onto the forward surfaces of the stripper bars rearwardly of the pusher shoulders 165*a*. Then, when the other ends of the power cylinders are energized, the stripper bars 165 move rearwardly, causing the lower edges of the rear corner members 141 and 142 of the hopper to strip the deckboard from the upper surfaces of the bars and causing it to assume a position forwardly of the pusher shoulders 165*a* when the stripper bars come to rest in retracted position.

The nailing machine 28 is generally similar to that disclosed in Richards U.S. Pat. No. 2,856,606.

In general, the nailer comprises a support structure which includes a pair of support walls 180 and 181 (FIG. 12). A shaker type nail feed mechanism is mounted at the upper end of the support structure and includes a nail hopper 182 which is continuously oscillated in a vertical direction by a rod 183 connected to a crank. Nails are directed from the hopper into a plurality of parallel downwardly-inclined runways each of which has a rotary nail pick at its lower end for removing nails one by one from the runway and dropping them into a funnel for delivery through a tube 184 to a nail chuck 185 disposed in spaced relation above an anvil 186. In the Richards machine there are twelve nail-picking units disposed in side-by-side relation across the machine for directing nails into twelve chucks which are also disposed in side-by-side relation extending across the machine. In the present machine there are twelve nail-picking units disposed side-by-side as in the Richards machine, however, the nail chucks 185 are arranged in four units each having three chucks disposed in a line extending longitudinally of the machine in a manner to be described presently. The tubes extending between the funnels of the nail-picking units to the chucks are made of a suitable length and bent to accommodate the longitudinal disposition of the chucks.

Figure 14:
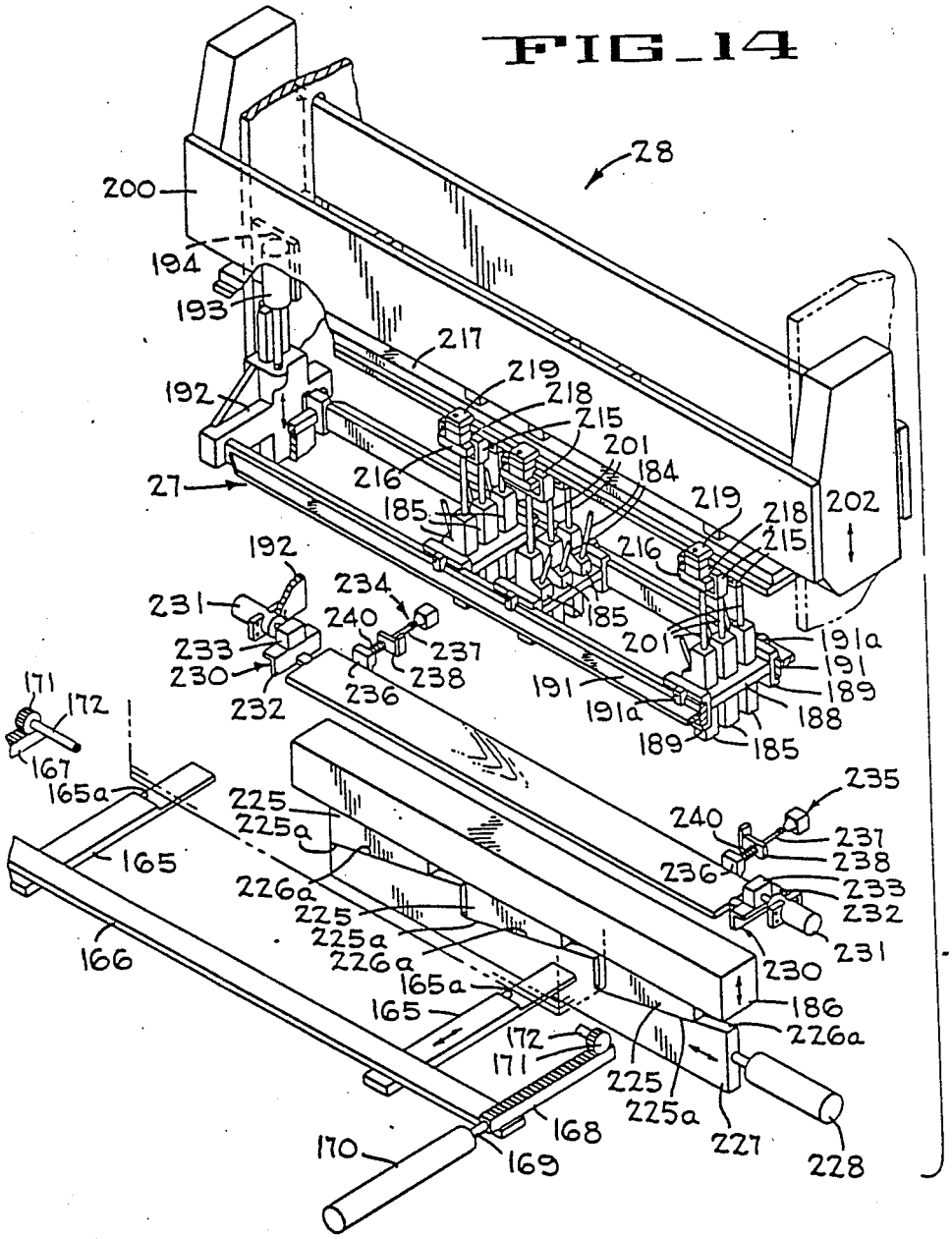
FIG. 14 is an exploded fragmentary isometric view of parts of machine of FIG. 12.

In FIG. 14, three of the four chuck units are shown, one being omitted to show other structure. Each unit comprises a plate 188 in which three chucks are mounted in upright position. At each end the plate 188 has a U-shaped slide 189 and each slide is disposed on a transverse bar 191 and is locked thereon by a releasable clamp 191*a*. Each of the transverse bars 191 is secured at each end in an end plate 192 (one only being shown in FIG. 14). Each end plate is raised and lowered by means of a double-acting pneumatic power cylinder 193, each cylinder being mounted on a plate 194 secured to and extending inwardly from one of the side walls 180 or 181 of the machine.

The nails are forced out of the chucks and into the deckboards and stringers by a vertically reciprocable nail-driving head 200 (FIG. 14) which carries twelve punches 201 (nine only being shown), each punch being adapted to pass downwardly into one of the chucks to contact the head of the nail therein.

In the past, machines of the type described above have employed a crank drive for their nailing heads as described in U.S. Pat. No. 4,392,600. This provides a vertical stroke of fixed length, which has a disadvantage in that nails are uniformly driven to a predetermined level in the stringers, regardless of variations in deckboard thickness. An additional disadvantage is that the surfaces which support the pallets during manufacture must be adjusted in height for each different pallet height desired.

In accordance with a feature of the present invention, the nail-driving head 200 is reciprocated vertically by a pair of hydraulic cylinders 300. Each cylinder has a lower end connected to the nailing head and an upper end connected to an associated side wall 180, 181. To regulate stroke length so that nails are uniformly driven to predetermined depths in the deckboards, a limit switch 302 for sensing the position of the head 200 is mounted on the vertically movable chuck assembly. A bolt 304 extends downward from the head to trigger the limit switch when the punches are in a predetermined position with respect to the chucks. The bolt 34 may be rotated about its axis to adjust its vertical position so as to facilitate adjustment of the depth to which the nails are driven.

In the Richards machine, the twelve nail punches are mounted in side-by-side relation to move downwardly through the twelve side-by-side chucks. In the present machine, the twelve punches 201 (FIG. 14) are mounted in four groups of three generally longitudinally-aligned punches and are disposed directly above the grouped chucks 185 therebelow. Each of the punches has a bracket 215 at its upper end which has inwardly extending arms overlying the opposite side edges of a short plate 216 that extends under a horizontal plate 217 connected to the nail-driving head 200. Each plate 216 has a short bar 218 secured to and extending along its upper surface, and each bar 218 is adjustably clamped to the horizontal plate 217 of the driving head 200 by a clamp 219. Accordingly, it is evident that each group of three nail punches can be easily aligned over a group of three chucks for movement down through the chucks as the head 200 is moved downward and up out of the chucks when the head is lifted.

The anvil 186 is mounted directly below the nailing chucks and comprises a steel bar of generally square cross-section having three lift plates 225 secured in a line longitudinally of the anvil to the undersurface of the anvil. Each lift plate has an inclined lower surface 225*a* that engages one of three oppositely inclined surfaces 226*a* on an actuator bar 227 carried on the end of a double-acting power cylinder 228. The anvil 186 is supported and guided in the support structure of the machine for movement in a vertical direction, and the actuating bar 227 is supported and guided for movement in a horizontal direction under the urging of power cylinder 228. Referring to FIG. 6, it will be noted that, when new stringers are advanced to nailing position P3 they have no deckboards on their lower side. Accordingly, at this time, the anvil 186 is raised enough to support the stringers. When a half pallet moves through the nailing position, it has deckboards on its lower side and the anvil then remains in its lowered position with its support surface flush with the surface of two support plates 29 that extend across the machine.

During the nailing operation the deckboard is held between two clamps 230 (FIG. 14), each of which is actuated by a double-acting pneumatic power cylinder 231 that is mounted on the frame 192 of the chuck assemblies. Each clamp comprises a board-engaging member that has a flattened outer end and is welded at its inner end to an angle bar 232 that carries a block 233 on its upper surface. The block is secured to the outer end of the piston of the associated power cylinder. Since the power cylinders that carry the clamps 230 are mounted on the frame of the chuck assemblies, they move up and down with the chuck assemblies.

A pair of deckboard stops 234 and 235 are also mounted on the chuck assembly frame 192. Each stop includes a block 236 carried on a rod 237 that is slidable in a bracket 238 which is secured to frame 192. A coil spring 240, freely disposed on the rod 237 between the block 236 and the bracket 238, cushions the impact of the leading edge of the deckboard against the stop block 236.

The pallet turnover bar 29 is pivotally mounted substantially midway between the walls 180 and 181 on a rod 250 which is rotatably mounted in bearings carried by the walls and projects through wall 181. The bar is movable, between the upright half-pallet intercepting position shown in solid lines in FIG. 2 and the half-pallet depositing position shown in phantom lines, by a double-acting pneumatic power cylinder 252 which is mounted on the outside of wall 181 between a lateral support plate, that is connected to the frame structure of the machine, and an arm 254 keyed to the part of rod 250 which extends outwardly past the wall 181.

The turnover bar 29 is a steel member having a main body portion with a forward flat face 255, that is about two inches wide, extending for its full length including the surface 256 of an arm 257 that is pivotally mounted on the lower end of the bar and a beak portion 258 of the bar 29, the inner face 259 of which extends generally outwardly and rearwardly from the face 255 of the main portion of the bar at an angle of about 60 degrees. The arm 257 and the bar have abutment surfaces which permit the arm to pivot counterclockwise from the position shown in FIG. 2 but not clockwise.

The action of the turnover bar is shown in FIGS. 15–19. It will be noted in FIG. 15 that when the gripper carriage moves toward the right to push a completed pallet to the discharge station P5, the deckboards on the leading pallet and on the trailing half-pallet engage the arm 257 and pivot it upward as they pass thereunder to obtain clearance. Then, after the full pallet has been released and the half pallet is being pushed rearwardly, the deckboard DB1 at the leading end of the half pallet engages the guide surface of arm 257 and rides up the surface as seen in FIG. 16. When the deckboard DB1 reaches a position approximately halfway between the pivot rod 250 and the point where the surface 255 of the main body portion of the bar meets the surface 259 of the beak portion, the power cylinder 252 is actuated to extend the piston rod to pivot the bar clockwise about rod 250. The speed of pivoting of the turnover bar is coordinated with the speed of upward movement of the deckboard DB1 so that the half pallet is progressively pivoted clockwise as the two gripper carriages rotate about shaft 60. After the deckboard DB1 reaches the point where the guide surfaces 255 and 259 meet each other and the deckboard starts to move along a downwardly descending arc, it moves into engagement with the guide surface 259. During continued rotation of the gripper carriage as it moves rearwardly, the deckboard DB1 slides down the guide surface 259 and is eventually deposited relatively gently on the guide channels. It will be evident that the timing of the pivoting movement of the bar must be such that the arm 257 at its lower end will be raised high enough to permit the half pallet to pass under it. The bar is held in the clockwise pivoted position until the entire half pallet has moved past the arm 257 after which it is returned to the position of FIG. 2.

In FIG. 2 the arcuate center line 265 below the turnover bar 29 indicates that, during the clockwise pivoting movement of the bar, the lower end of the arm 257 passes below the plane of the upper surfaces of the two support plates 229. Accordingly, no plates that extend across the machine can be located at the area. Similarly, as seen in FIG. 17, parts of the gripper head 22 also pass below the plane of the support plates 229. To provide support for the outer ends of the half pallets and full pallets being advanced by the gripper carriage after these end portions leave the last support plate 229, four narrow bars 266 (FIG. 4) are mounted on the downstream side of that support plate. The upper surfaces of these bars are in the horizontal plane of plates 229, and they are mounted on the frame structure of the machine in any suitable way, and are narrow enough to support the stringers without interfering with the grippers as they pass below the plane of plates 229, the pads of each gripper head being spaced apart a distance greater than the width of each bar.

Figure 20:
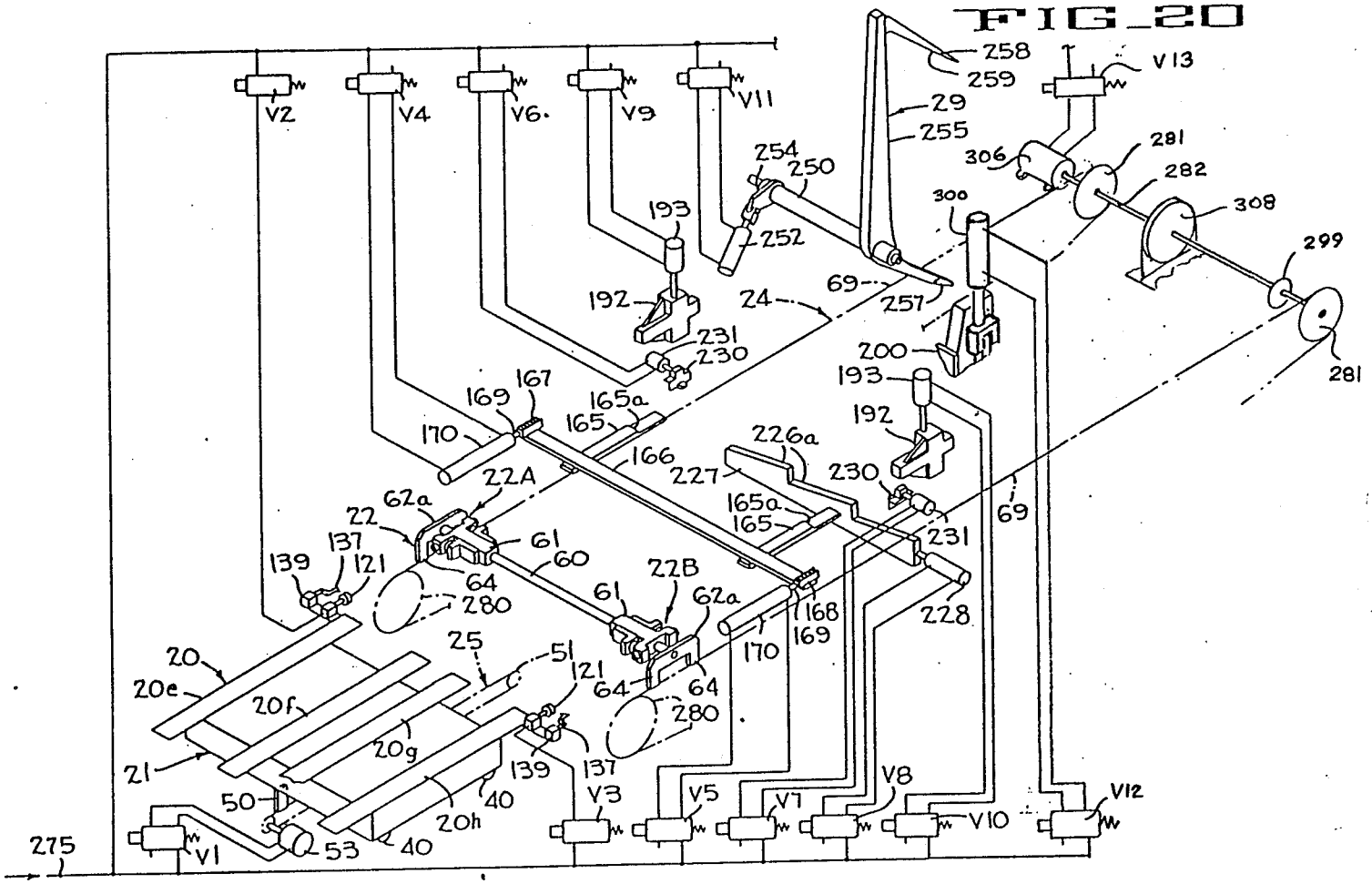
FIG. 20 is a diagrammatic view showing several of the drive mechanisms and the valves and solenoids for controlling their operation.

In FIG. 20 the drive mechanisms of the machine and several of the control devices are illustrated schematically. As mentioned previously, the stringer roller carriage 21 is actuated by an air motor 53 which is controlled by a valve V1 connected to an air supply header. The air chucks 121 receive air from the header 275 through valves V2 and V3. The solenoids 139 that actuate the latches 137 to release the stringer carriage from the gripper carriage are connected to a suitable source of electrical power. The cylinders 170 that move the stripper bars of the deckboard feeder back and forth are connected to the air supply header through valves V4 and V5. Valves V6 and V7 control the cylinders 231 that actuate the deckboard clamps 230. A valve V8 is connected between the header and the cylinder 228 that raises and lowers the nailing anvil by means of the slide bar 227 which has the inclined camming surfaces 226*a*. The cylinders 193 which raise and lower the nailing chucks through the end plates 192 of the chuck unit are connected through valves V9 and V10 to the header. A valve V11 connects the cylinder 252 of the half-pallet inverting bar 29 to the header. A pair of valves V12 control the two cylinders 300 which drive the nailing head 200. Only one of each of the valves V12 and cylinders 300 is shown in FIG. 20.

In accordance with a feature of the invention, the carriage is driven by an improved drive system which eliminates the electric motor and clutch-brake units used in the apparatus of U.S. Pat. No. 4,392,600, and instead employs a hydraulic motor 306 and an electromagnetic brake 308. Valve V13 controls the hydraulic motor 306 which drives the gripper carriage through endless chains 69. The chains 69 are trained around sprockets 280 journaled on a cross shaft (not shown) and two sprockets 281 keyed to a drive shaft 282.

The method and apparatus of the invention are controlled by a computer system which enables the operator to input the desired pallet configuration or select from previously input configurations. The preferred system comprises an Allen-Bradley processor and a Xycom Rac-Pac terminal which is suitable for use under plant environmental conditions. The method of control is similar to that described in U.S. Pat. No. 4,392,600.

The control of horizontal position of the gripper carriage is somewhat complex in that the time interval between the point at which the control system begins deceleration and the point at which the carriage stops is not uniform, due to variations in the velocity of the carriage. Accordingly, for each point at which the gripper carriage is to stop in constructing a particular pallet, it may be necessary to determine the distance required for deceleration and program the control system to begin deceleration at the appropriate point prior to the desired stopping point. To eliminate the need for such manual operations, the control system may include a servo system which continuously monitors the position and velocity of the gripper carriage to determine the appropriate deceleration for each stopping point and effects the appropriate deceleration through the use of a metered valve controlling flow through the drive motor 306.

From the foregoing, it should be appreciated that the invention provides a novel and improved method and apparatus for constructing wooden pallets. Various features of the invention are set forth in the following claims.

What is claimed is:

1. A method of manufacturing wooden pallets comprising the steps of:

(a) placing a plurality of stringers in parallel with one another at predetermined spacing on a stringer loading station;

(b) gripping forward ends of the stringers with a plurality of grippers disposed on a gripper carriage;

(c) pulling the stringers forward longitudinally to a deckboard installation station and positioning the stringers in a predetermined position for receiving a first deckboard;

(d) positioning a deckboard transversely on said stringers;

(e) lowering a transversely-oriented chuck assembly to said deckboard so that said chuck assembly abuts the upper surface of that deckboard without contacting any others;

(f) feeding a plurality of nails into said chuck assembly;

(g) lowering a plurality of punches into contact with said nails to drive said nails through said deckboards and into said stringer, with said nails being guided by said chuck assembly;

(h) sensing when said punches reach a predetermined position with respect to the upper surface of said deckboard;

(i) reversing said punches upon said punches reaching said predetermined position with respect to said upper surface of said deckboard, thereby determining a lower end of each stroke individually for each deckboard so that said nails are driven reliably to a predetermined depth in each deckboard;

(k) advancing said stringers to additional predetermined positions and attaching additional transversely-oriented deckboards thereto by repetition of steps d–j to produce a half-pellet;

(l) advancing said half-pellet forwardly, then reversing the direction thereof to invert said half-pallet through the use of a turnover assembly which rotates said half-pallet about a transverse axis;

(m) pulling said half-pallet back through said deckboard installation station to a predetermined position rearwardly thereof;

(n) advancing said half-pallet through said deckboard installation station for installation of a second set of deckboards in accordance with steps c–k to produce a completed pallet; and (o) advancing the completed pallet to a delivery station.

2. A method in accordance with claim 1 wherein each of the steps of advancing said stringers to predetermined positions comprises rotating a chain drive through the use of a hydraulic motor to pull said stringers forward.

3. A method in accordance with claim 1 wherein the step of lowering said punches comprises the step of operating hydraulic cylinders disposed on either side of the nailing head supporting said punches, and wherein the step of reversing said punches comprises the step of reversing the direction of operation of said hydraulic cylinders.

* * * * *